US010018316B2

(12) United States Patent
Chen et al.

(10) Patent No.: US 10,018,316 B2
(45) Date of Patent: Jul. 10, 2018

(54) HEADLIGHT MODULE

(71) Applicant: Lumileds Holding B.V., Schiphol (NL)

(72) Inventors: Fei Chen, Aachen (DE); Kang Lu, Aachen (DE)

(73) Assignee: Lumileds Holding B.V., Schiphol (NL)

( * ) Notice: Subject to any disclaimer, the term of this patent is extended or adjusted under 35 U.S.C. 154(b) by 0 days.

(21) Appl. No.: 15/579,564

(22) PCT Filed: Jun. 3, 2016

(86) PCT No.: PCT/EP2016/062623
§ 371 (c)(1),
(2) Date: Dec. 4, 2017

(87) PCT Pub. No.: WO2016/198329
PCT Pub. Date: Dec. 15, 2016

(65) Prior Publication Data

US 2018/0163939 A1 Jun. 14, 2018

(30) Foreign Application Priority Data

Jun. 9, 2015 (WO) ..... PCT/CN2015/081087

(51) Int. Cl.
*F21S 41/143* (2018.01)
*F21S 41/147* (2018.01)
(Continued)

(52) U.S. Cl.
CPC ..... *F21S 41/143* (2018.01); *F21S 41/147* (2018.01); *F21S 41/24* (2018.01); *F21S 41/321* (2018.01);
(Continued)

(58) Field of Classification Search
CPC ..... F21S 41/143; F21S 41/24; F21S 41/663; F21S 41/147; F21S 41/136; F21S 41/321; F21S 41/43; F21S 41/255
(Continued)

(56) References Cited

U.S. PATENT DOCUMENTS 4,811,174 A * 3/1989 Kanzler ..... F21S 48/1266 362/297
7,401,947 B2 * 7/2008 Wanninger ..... F21S 48/1154 362/300
(Continued)

FOREIGN PATENT DOCUMENTS

JP 2013242996 A 12/2013
KR 101307976 B1 9/2013

OTHER PUBLICATIONS

EPO as ISA, "International Search Report and Written Opinion" dated Sep. 19, 2016 from International Application No. PCT/EP2016/062623, filed Jun. 3, 2016, 10 pages.

*Primary Examiner* — Laura Tso
(74) *Attorney, Agent, or Firm* — Brian D. Ogonowsky; Patent Law Group LLP

(57) ABSTRACT

The invention provides a headlight device capable of generating two distinct, though possibly overlapping, beam portions, by means of a single integrated unit. The unit comprises two primary optical components for generating the two respective beam portions, and a single exit lens through which the combined beam is transmitted. A low beam having a stepped cut-off—to avoid glare to oncoming road users—may be generated by means of the provided device, with the cut off generated by means of a specially shaped collimating element, and the remaining spread of the beam generated by means of a downwardly reflecting reflector. Dual high and low beam functionality can alternatively be achieved, wherein the collimating element generates a
(Continued)

high beam, and the reflector structure generates a low beam. By shaping and positioning the collimating element appropriately, a stepped cut off in the low beam may be still be provided in these embodiments.

13 Claims, 9 Drawing Sheets

(51) Int. Cl.

| | |
|---|---|
| ***F21S 41/24*** | (2018.01) |
| ***F21S 41/36*** | (2018.01) |
| ***F21S 41/43*** | (2018.01) |
| ***F21S 41/663*** | (2018.01) |
| ***F21S 41/32*** | (2018.01) |
| *F21S 41/255* | (2018.01) |

(52) U.S. Cl.
CPC ..... *F21S 41/36* (2018.01); *F21S 41/43* (2018.01); *F21S 41/663* (2018.01); *F21S 41/255* (2018.01)

(58) Field of Classification Search
USPC ..... 362/538, 511
See application file for complete search history.

(56) References Cited

U.S. PATENT DOCUMENTS

| | | | | |
|---|---|---|---|---|
| 7,611,272 | B2 * | 11/2009 | Specht | F21S 41/143 362/555 |
| 8,569,942 | B2 * | 10/2013 | Kishimoto | F21S 41/16 313/483 |
| 9,157,595 | B2 * | 10/2015 | Hager | F21S 41/143 |
| 2010/0226142 | A1 | 9/2010 | Brendle et al. | |
| 2014/0226354 | A1 * | 8/2014 | Mugge | F21S 48/24 362/511 |
| 2014/0268848 | A1 * | 9/2014 | Tessnow | F21S 48/1241 362/511 |
| 2014/0321141 | A1 | 10/2014 | Bauer et al. | |
| 2015/0131324 | A1 * | 5/2015 | de Lamberterie | G02B 6/0035 362/623 |

* cited by examiner

HEADLIGHT MODULE

CROSS-REFERENCE TO RELATED APPLICATIONS

The present application is a § 371 application of International Application No. PCT/EP2016/062623 filed on Jun. 3, 2016 and titled "HEADLIGHT MODULE," which claims the benefit of International Application No. PCT/CN2015/081087 filed on Jun. 9, 2015. International Application No. PCT/EP2016/062623 and International Application No. PCT/CN2015/081087 are incorporated herein.

FIELD OF THE INVENTION

The invention relates to automotive headlight devices, in particular to LED headlight devices.

BACKGROUND OF THE INVENTION

Automotive front headlights are typically required to operate in both a low-beam and a high-beam mode. A low-beam mode is designed to restrict or constrain the upward projection of light, to avoid causing glare to oncoming road users. Most low-beam headlights are also tailored specifically for use on one side of the road only (either left or right), and are adapted to direct the major portion of their light toward the driver's own side of the road, while 'dipping down' on the other side—again to avoid causing glare to the oncoming vehicles. Headlight units typically achieve this by generating a substantially horizontal upper 'cut-off' in the projected light, above which is dark, below which is light. The cut-off profile dips downward on the driver's near-side direction (avoiding glare) but sweeps or steps upward on the driver's offside direction, to assist in illuminating road-signs and passing pedestrians.

Typically, the generation of such a low-beam requires the separate generation of two distinct component beams: a first to create the sharp stepped cut-off shape across the top of the beam profile, and a second to create the remaining spread of illumination below the cut-off line. This usually requires separate units to generate each component, which adds significant bulk, weight and cost to the headlight unit.

In addition to this, there exist parallel inadequacies in the generation of high beams within the headlight units. Dual high and low beam functionality is typically achieved by means either of a moveable (for example up/down) shield which allows switching between a lower cut off and a high cut off, or by means of a very thin shield. In the former case, it is necessary to provide actuation components (for example a solenoid) to facilitate the movement of the shield, which adds cost and complication to the device. In the latter case, the thin shields require highly precise manufacturing, necessitating computerised numerical control (CNC) methods for their production—again adding significant cost to the production process.

Desired therefore, to allow solution of one or both of these parallel problems, is a headlight unit providing generation of two distinct (but possibly overlapping) beam components, by means of a single, integrated module which does not necessarily require moving parts, wherein one or both of the beam components generate at least a low-beam having a stepped upper cut-off for preventing glare.

SUMMARY OF THE INVENTION

The invention is defined by the claims.

According to an aspect of the invention, there is provided a headlight module for outputting a low beam profile including a cut off section for projection towards a driver-side road section, the headlight module comprising:

an exit lens comprising an optical axis extending through said exit lens;

a low beam unit for generating at least a portion of said low beam profile, the low beam unit comprising:

- a first LED for generating a first luminous distribution; and
- a reflector structure for reflecting the first luminous distribution onto a first region of the exit lens to generate said at least portion of the low beam profile;

a second beam unit in between the low beam unit and the exit lens, the further beam unit comprising:

- a second LED; and
- a collimating element being optically coupled with the second LED through a light input window and having a light output window facing the exit lens such that the light output window generates a second luminous distribution onto a second region of the exit lens, the collimating element comprising a surface including a stepped profile for generating said cut off section.

The reflector structure may, for example, comprise an ellipsoid reflector structure, or hemi-ellipsoid reflector structure, having a reflective inner surface, and arranged to arch over the top of the first LED and, in some cases, arch additionally over the top of the second beam unit.

The first LED, and optically coupled second LED and collimating element, may be arranged linearly with respect to one another, at points along or about an imaginary axis parallel or substantially parallel with the optical axis of the exit lens. For example, the first LED, and optically coupled second LED and collimating element may be arranged in row, with the first LED positioned behind the coupled second LED and collimator. The reflector structure may be arranged symmetrically with respect to said imaginary axis, or with respect to the optical axis of the exit lens, for example, such that the respective axis effectively delineates two identical 'halves' or 'wings' of the reflector structure, each extending laterally out from said axis.

The first LED may be arranged to output a first luminous distribution along an axis substantially perpendicular to the optical axis extending through the exit lens, toward the inner surface of the overarching reflector structure. For example, the optical axis of the exit lens may comprise a substantially horizontal axis, i.e. an axis which lies in a horizontal plane. The first LED may be arranged in this case to output its luminous distribution in a substantially vertical direction, i.e. along an axis which lies in a vertical plane or substantially vertical plane.

The second region of the exit lens (the region of incidence of the second luminous distribution on the exit lens) may be adjacent to or overlapping with the first region of the exit lens (the region of incidence of the first luminous distribution on the exit lens). For example, the second region may extend above the first region, to form the upper cut off for the lower beam portion, or in alternative examples, to form an upper (for example high) beam portion. The lower region may extend below the second region to form the major lower spread of the output beam. In any embodiment, the two regions may overlap to some extent.

According to a first set of embodiments, the second luminous distribution is a further portion of the low beam profile, said further portion including the cut off section, and wherein the stepped profile delimits the light output window. The stepped profile hence delimits in this case the collimating shape of the collimating element and therefore defines the shape of the second luminous distribution on being output through the collimator exit window. The low beam with stepped cut off is generated in this case by activation of both the first and second LED.

The collimating element may further comprises a planar further surface opposite the surface which incorporates the stepped profile, said further surface comprising a further surface portion adjoining the light output window of the collimating element, the further surface portion carrying a reflective coating. For example the surface including the stepped profile may, in some cases, form a lower surface or boundary or wall of the collimating element, and the further surface may form an upper surface or boundary or wall of the collimating element. Both surfaces may be reflective, for example comprising a reflective coating. In this way, the shape or outline defined by the collimator exit window, delimited at its base by the stepped profile, is inverted on projection toward the exit lens, such that the beam profile (falling on or defining the second region of the exit lens) comprises a stepped upper boundary.

The collimating element may comprise a first reflector including the surface incorporating the stepped profile, and an opposing second reflector including the above described further surface. The first reflector and the second reflector may in this case be spatially separated. According to other examples, the collimating element may comprise a different kind of optical element, for example a collimating lens, or collimating channel, for example a TIR collimator.

The headlight module comprises a planar shutter element positioned within the light path of the reflected first luminous distribution, substantially parallel with the surface incorporating the stepped profile, for creating an upper horizontal cut-off to the lower beam profile, the planar shutter element comprising a first planar portion positioned adjacent to a first lateral side of the surface, and having a first curved front edge which curves toward the exit lens, and a second planar portion positioned adjacent to a second lateral side of the surface, and having a second curved front edge which curves toward the exit lens.

The planar shutter element may be arranged substantially parallel with a horizontal plane, for example. The front curved edges of the two halves or 'wings' (planar portions) may be arranged so as to respectively curve from points adjacent and aligned with either end of the stepped profile, and to arc outward in a direction toward the exit lens. The shutter element may provide a sharp horizontal (i.e. 0 degree) upper cut off line to the low beam profile at either side of the stepped cut off formed by the stepped profile. To this end, the two planar portions may be arranged at differing vertical positions, each arranged parallel with one of the two vertical 'levels' defined by the stepped profile.

According to a second set of embodiments, the second luminous distribution may be a high beam portion, and wherein the stepped profile is positioned within the light path of the reflected first luminous distribution and comprises a reflective surface for creating said cut off section in the low beam profile. In this case, activation of just the first LED generates a low beam having a stepped cut off. Activation of just the second LED generates just a high beam portion. Activation of both LEDs generates a combined high and low beam.

The stepped profile may be comprised by a reflective surface disposed above the collimating element for example, or disposed atop an upper boundary of the collimating element. Since the stepped profile is positioned within the light path of the reflected first luminous distribution the profile creates a stepped upper cut off to the low beam portion, whether or not the second LED is active.

The reflective surface (comprising the stepped profile) may be comprised by a curved reflector having:

a first curved section adjacent to a first end of the stepped profile and curving towards the exit lens; and a second curved section adjacent to a second end of the stepped profile opposite said first end and curving towards the exit lens, wherein the first curved section is vertically displaced relative to the second curved section.

The curved reflector may in this case provide a sharp horizontal (for example 0 degree) cut-off to the lower beam portion generated by the first LED and the reflector structure. A horizontal cut off may be generated by the curved reflector for example at either side of the stepped cut-off generated by the reflective stepped profile.

In some examples, the curved reflector may be integral to the collimating element, for example extending directly out from an upper boundary of the collimating element exit window.

The light output window of the collimating element may be larger than the light input window and have a lower boundary extending below the lower boundary of the light input window.

According to either of the above described sets of embodiments, the stepped profile may be shaped to define a cut off portion having a cut off angle of 15 or 45 degrees with respect to a horizontal plane. The cut off angle in this case may define the angle of a sloping portion of the stepped profile, the sloping portion linking first and second horizontal portions, the horizontal portions vertically displaced from one another.

The reflective surface area of the reflector structure may be greater than the area of the light output window of the collimating element, such that the low beam unit is adapted to generate a major area of a combined beam profile generated by the low beam unit and the further beam unit.

The reflector structure may be an ellipsoidal reflector structure comprising a first focal point and a second focal point, wherein the first LED is placed in the first focal point and the second focal point is located between the collimating element and the exit lens.

According to one or more embodiments, the headlight module may further comprise one or more motor or actuation elements for adjusting a position and/or relative orientation of the collimating element. This may allow, for example, implementation of adaptive front-lighting systems (AFS), wherein the direction and/or shape of headlight beams may be adapted dynamically for differing conditions for example.

According to a further aspect of the claim, there may be provided a vehicle comprising a headlight module in accordance with any of the above described embodiments.

BRIEF DESCRIPTION OF THE DRAWINGS

Embodiments of the invention are described in more detail and by way of non-limiting examples with reference to the accompanying drawings, wherein FIG. 1 schematically depicts a perspective view of a first example headlight module.

DETAILED DESCRIPTION OF THE EMBODIMENTS

Figure 1:
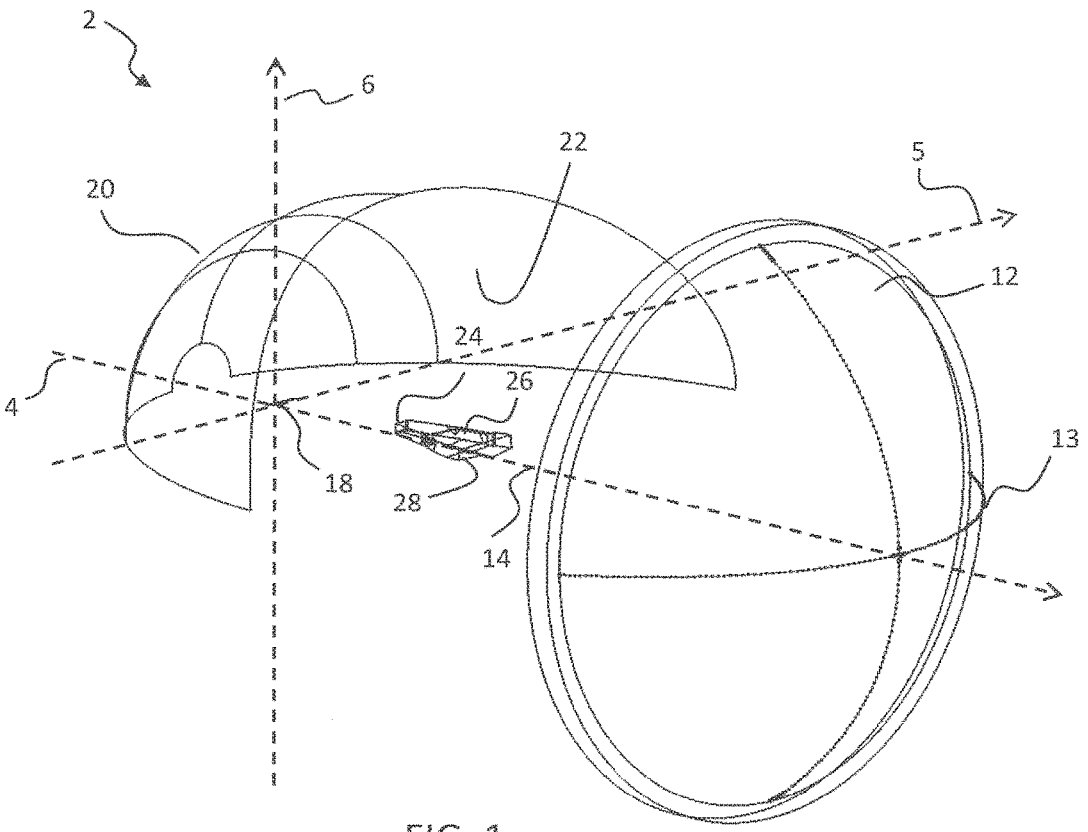

The invention provides a headlight device capable of generating two distinct, though possibly overlapping, beam portions, by means of a single integrated unit. The unit comprises two primary optical components for generating the two respective beam portions, and a single exit lens through which the combined beam is transmitted. A low beam having a stepped cut-off—to avoid glare to oncoming road users—may be generated by means of the provided device, with the cut off generated by means of a specially shaped collimating element, and the remaining spread of the beam generated by means of a downwardly reflecting reflector. Dual high and low beam functionality can alternatively be achieved, wherein the collimating element generates a high beam, and the reflector structure generates a low beam. By shaping and positioning the collimating element appropriately, a stepped cut off in the low beam may still be provided in these embodiments.

Embodiments of the invention hence effectively combine a standard Poly Ellipsoid System (PES) arrangement (comprised of a light source, a curved redirecting reflector and an exit lens) with an additional primary optical component (a collimating element) in order to thereby provide both a wide-distribution low beam element, and a smaller, highly concentrated beam element, the latter of which may be employed to add shape to the wide-distribution element, or to provide its own distinct auxiliary (high-intensity) beam.

It should be understood that the Figures are merely schematic and are not drawn to scale. It should also be understood that the same reference numerals are used throughout the Figures to indicate the same or similar parts.

Figure 2:
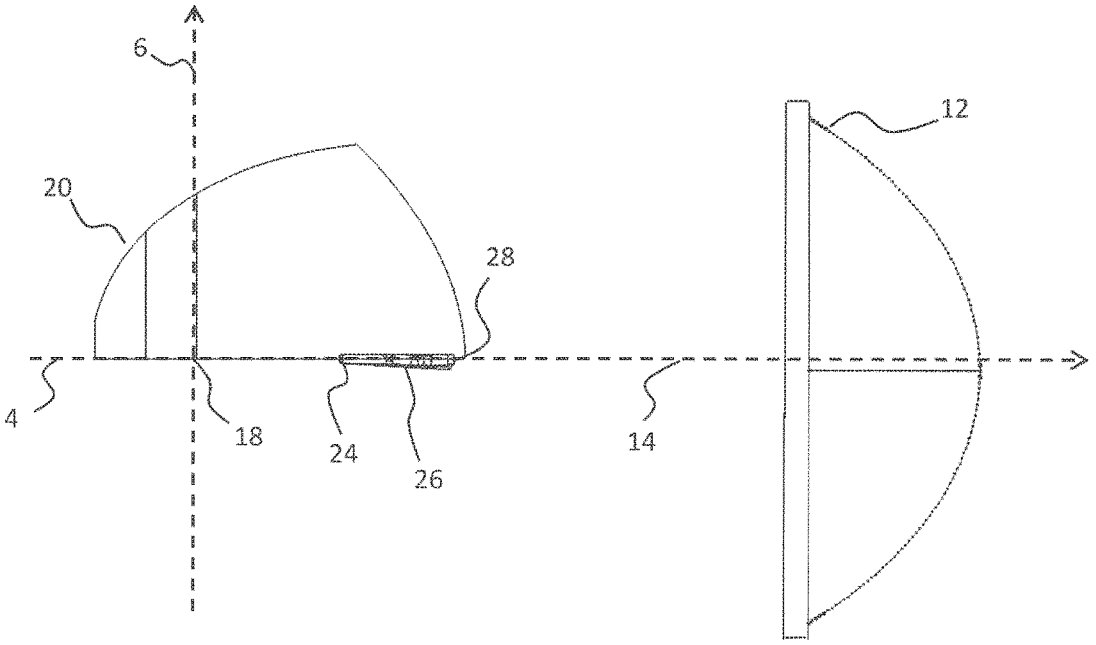
FIG. 2 schematically depicts a profile view of the first example headlight module.

In FIGS. 1 and 2 are schematically depicted perspective and profile views respectively of a first example headlight module 2, adapted to generate a low beam having a stepped upper cut off. An open ellipsoidal reflector structure 20 is arranged having one open side facing in the direction of an exit lens 12, such that a focal point of the reflector structure is located near the proximal position of the exit lens. The (open) base of the reflector structure is aligned with a (virtual) horizontal plane (defined by axes 4 and 5) which passes directly through the vertical centre 13 of the exit lens. The reflector structure is furthermore arranged symmetrically about a central optical axis 14 of the exit lens, i.e. said optical axis 14 lies on a (vertical) plane of (reflective) symmetry (defined by axes 4 and 6) running through the reflector.

Arranged beneath the reflector structure 20 are a first LED 18 and a second LED 24, the second LED being directly optically coupled with the light input window 36 of a collimating element 26, also arranged beneath the reflector structure. The first LED, and optically coupled second LED and collimating element, are arranged along a common axis 4, with the first LED positioned 'behind' the coupled collimating element and second LED. Furthermore common axis 4 is, in the example of FIG. 1, parallel with the optical axis 14 of the exit lens 12.

A first LED 18 is arranged having a light emitting surface facing in the direction of the reflective inner surface 22 of the ellipsoid reflector 20. The luminous output of the first LED is hence directed in a direction substantially perpendicular to the optical axis 14 of the exit lens 12. Light from the first LED is distributed across the inside of the reflector structure and redirected 'downward' toward a region on the exit lens substantially below its horizontal centre line 13. The light reflected from the reflective surface 22 hence forms the major lower 'spread' of the low beam profile output by the headlight module 2.

Note that in alternative examples, common axis 4 and optical axis 14 may not be aligned in parallel, but may deviate by some angular degree, for example to generate a laterally offset beam profile at exit lens 13, The vertical alignment of the reflector structure 20, relative to the exit lens, may also vary in different examples of the invention. For example, the reflector structure may be positioned at a higher vertical position, in order to generate a low beam spread which extends above the central horizontal line 13. In addition, the angular orientation of the reflector structure, with respect to the exit lens and/or the optically coupled second LED 24 and collimator element 26, may be different in alternative examples. For example, the base of the reflector may, in examples, be aligned with a (virtual) horizontal plane which is tilted by some amount with respect to the 'horizontal' plane defined by axes 4 and 5. Said tilt may be a tilt either in the direction of axis 5 (i.e. a left-right tilt), or in the direction of axis 4 (i.e. a forwards-backwards tilt), or a combination of both. Differing angular orientation of the reflector structure might be employed to generate differing beam profiles, shapes or directionalities, for example.

The collimating element 26 of the example of FIGS. 1 and 2 is positioned so as to coincide with a focal point of the ellipsoid reflector 20. The light output window 28 of the collimating element is arranged to point directly toward the exit lens, along an axis parallel with the optical axis 14. The collimated light output exiting the output window is therefore incident at the exit lens 12 at a (small) region proximal to the centre point of the lens. This region may overlap either partially or fully with the (broader) region covered by the reflected light from the first LED.

Note that although in the particular example of FIGS. 1 and 2, the collimating element 26 is shown orientated parallel with the horizontal plane defined by axes 4 and 5, in alternative examples, the relative angular orientation of the collimating element may vary. For example, the collimating element may be tilted by some angle with respect to said horizontal plane, either in the direction of axis 4 (i.e. up-down tilting), or the direction of axis 5 (left-right tilting) or some combination of both. Changing the angular orientation of the collimating element may, for example, change the degree to which the luminous output through output window 28 overlaps with the luminous distribution generated by the reflector structure 22.

Figure 3:
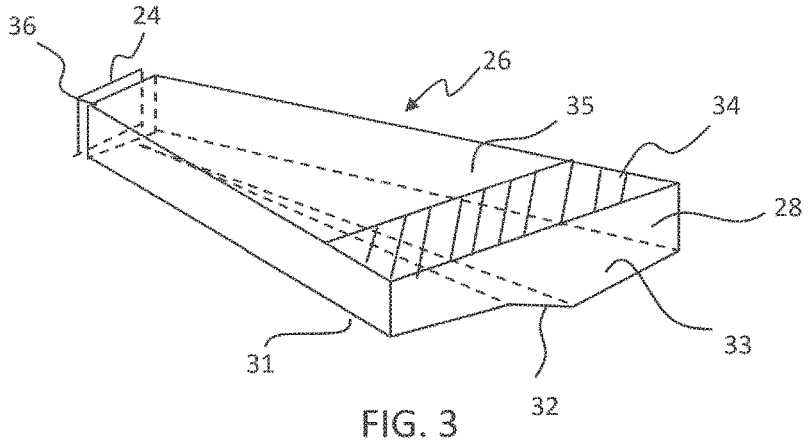
FIG. 3 schematically depicts a first view of a first example collimating element.
Figure 4:
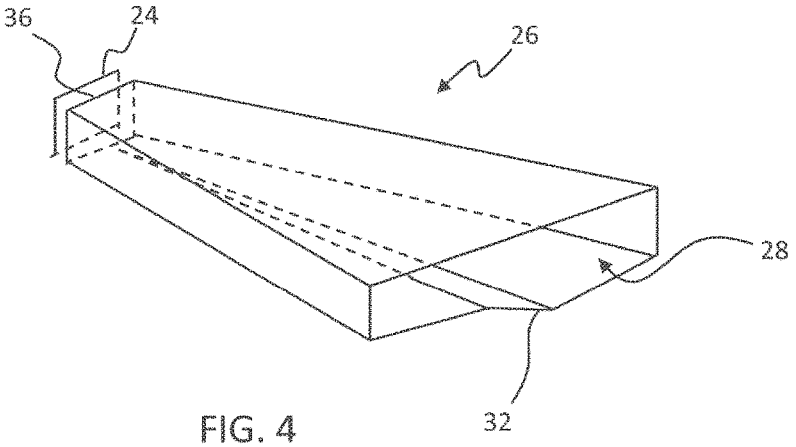
FIG. 4 schematically depicts a second view of the first example collimating element.
Figure 5:
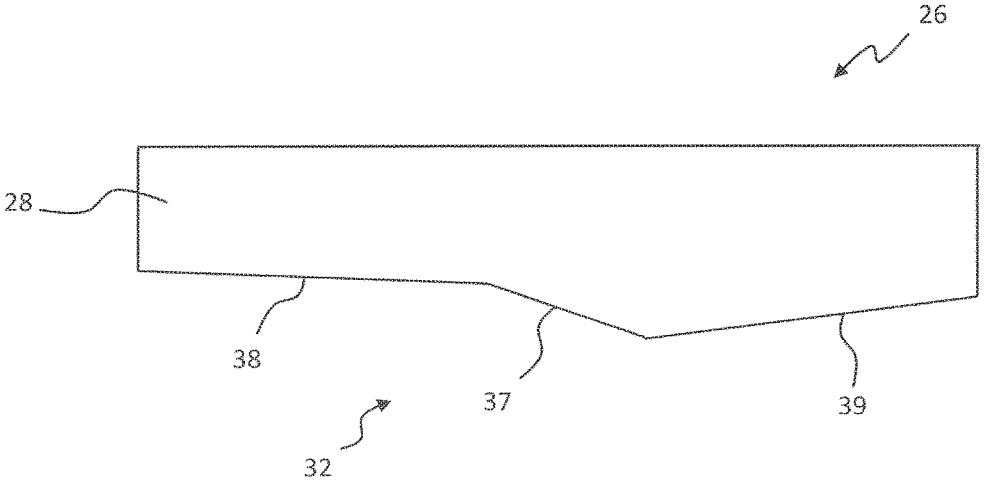
FIG. 5 depicts the cross-sectional profile of the light exit window of the first example collimating element.

In FIGS. 3-5 schematic illustrations show the collimating element 26 of the example of FIGS. 1 and 2 in more detail. At one end of the collimating element is a light input window 36, shown optically coupled with the second LED 24. Light enters the collimator at the input window and is reflected between an upper surface 35 and a lower surface 31, to form a beam at the exit window 28 having a shape which broadly follows (an inverted form of) the outline of the collimator cross-section (and therefore the outline of the light exit window 28). Both the light input window 36 and light output window 28 may be open, without a solid covering or boundary.

The shape of the light exit window 28 (and of the cross-section of the collimating element 26 more generally) is shown more clearly in FIG. 5. The stepped profile 32 defines a lower boundary of the exit window, while the upper boundary is, by contrast, broadly flat across its extent. The stepped profile comprises three linked portions: a central sloping portion 37 which runs at an angle between a first 38 (substantially horizontal) portion and a second 39, more shallowly sloping portion, the second portion vertically displaced from the first.

On approaching the exit window 28 of the collimating element 26, light incident on the surface portion 34 of surface 35 is reflected out through the exit window in a 'downwards' direction, while light incident on the corresponding (i.e. opposing) surface portion 33 of surface 31 is reflected 'upwards' out through the exit window. The shape of the light exit window is hence inverted on projection toward the exit lens 12, such that the stepped profile 32 forms a corresponding stepped upper cut off to the beam portion generated by the collimating element 26.

The angle of the sloping portion 37 may, by way of non-limiting example, be 15° with respect to a horizontal, or, for instance, 45° with respect to a horizontal. The angles of the three portions 37, 38, 39 of the stepped profile 32 are chosen so as to generate an upper cut-off to the low beam profile which is optimally angled to avoid glare to oncoming road users (on the opposite side of the road), while providing sufficient illumination for the user of the headlight module 2 on their own side of the road. The relative angles of the three portions may be varied therefore in applications of the invention intended for use in different countries, depending upon which side of the road vehicles drive in the country in question. In addition, the degree of slope of sloping portion 37 may be varied in differing applications, in dependence upon certain statuary safety regulations which are required to be met for example. Shallow sloping portion 39 may be angled, in examples, so as to provide optimal illumination of road-signs on a driver's side of a road (viewed at a distance for example) while also avoiding directing light into the eyes of passing pedestrians.

The surface portions 34 and 35, may according to examples be coated by a reflective coating, to optimise the optical efficiency of the collimating element.

Figure 6:
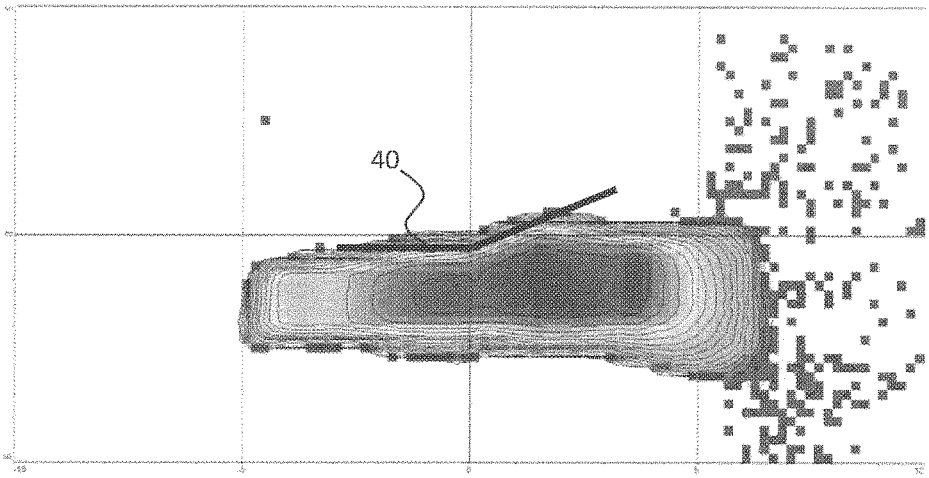
FIG. 6 depicts a simulated representation of a beam profile generated by the first example collimating element.

FIG. 6 depicts a simulated representation of the beam profile generated by optically coupled second LED 24 and collimating element 26. The stepped upper cut-off generated by stepped profile 32 is indicated by line 40.

Figure 7:
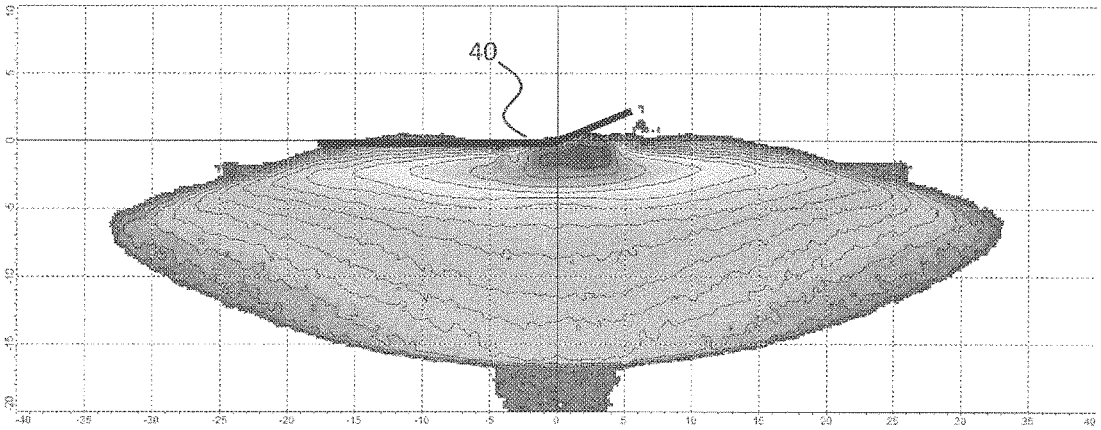
FIG. 7 depicts a simulated representation of the total beam profile generated by the first example headlight module.
Figure 8:
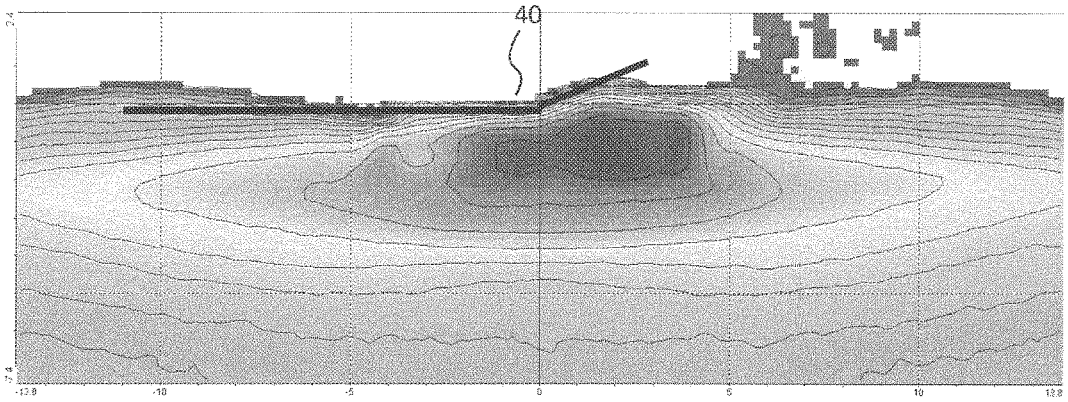
FIG. 8 depicts a second view of the simulation of the total beam profile generated by the first example headlight module.

FIG. 7 depicts a simulated representation of the total low beam profile generated by the example headlight module 2 wherein outputs from both reflector structure 20 and collimating element 26 are combined to form a low beam having a stepped upper cut-off to prevent glare to oncoming road-users. The stepped cut off of the beam profile of FIG. 7 is shown more clearly in FIG. 8, and indicated by line 40.

According to one or more embodiments of the invention, the headlight module 2 may further comprise a fixed planar shutter element for creating a horizontal (0 degree) cut-off of the low beam profile at either side of the stepped cut-off portion of the generated beam.

Figure 9:
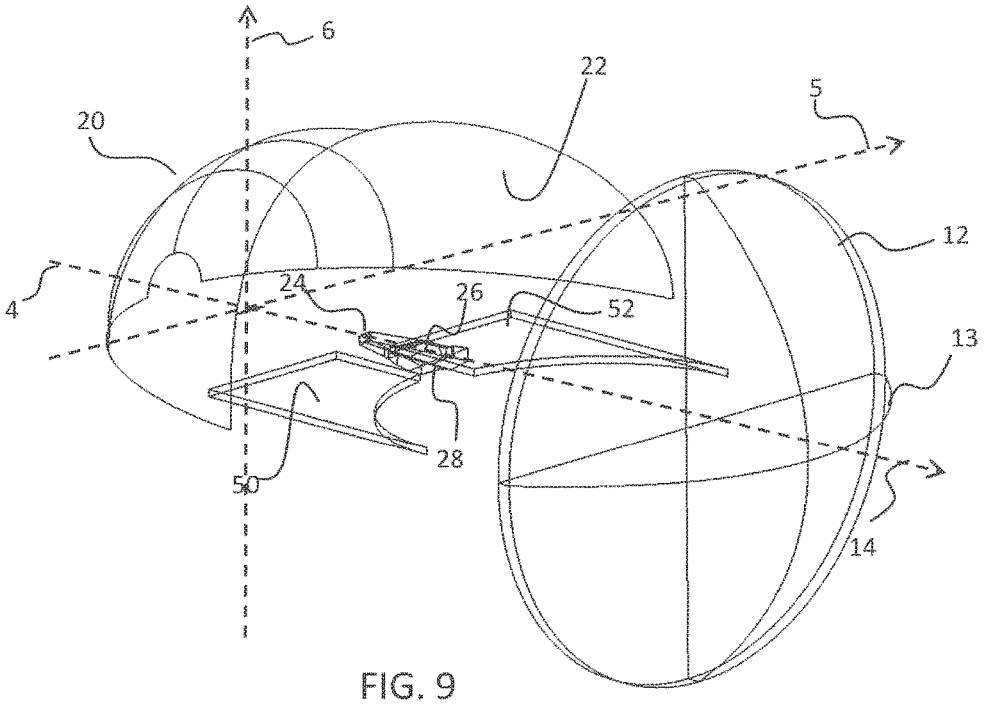
FIG. 9 schematically depicts a perspective view of a second example headlight module.
Figure 10:
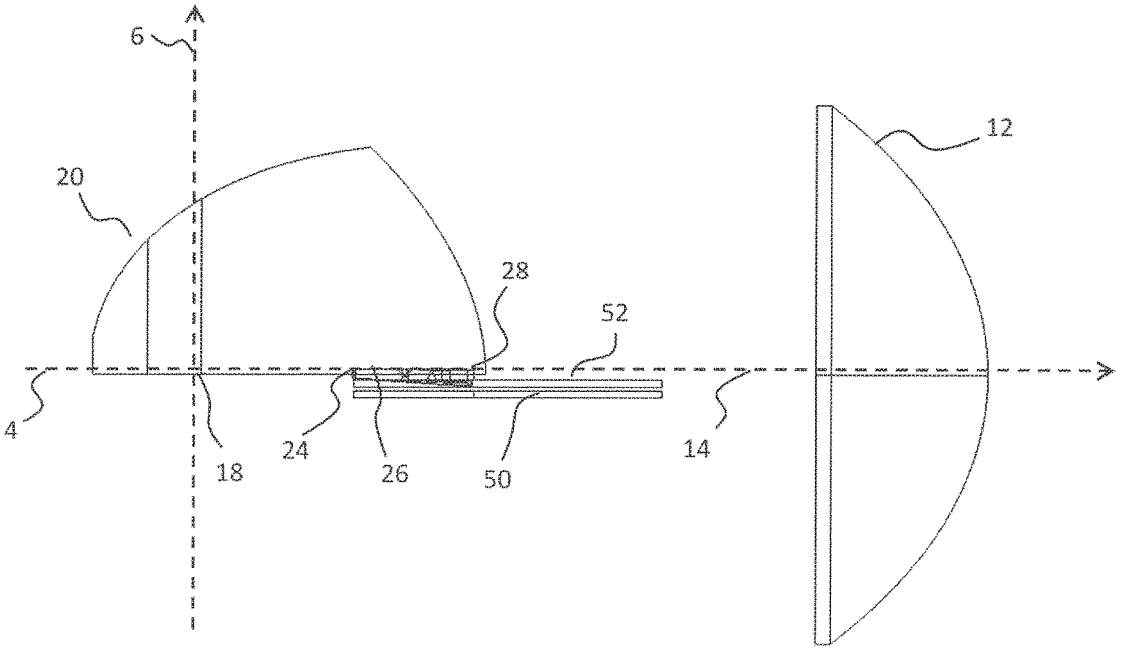
FIG. 10 schematically depicts a profile view of the second example headlight module.

FIGS. 9 and 10 schematically depict perspective and profile views of an example headlight module 2 comprising a planar shutter element, the planar shutter element formed of a first planar portion 50 and a second planar portion 52, symmetrically arranged on either side of the collimating element 26. The planar portions each have a curved front edge, which arcs from a point directly adjacent to one end of the collimator stepped profile 32, outwards towards the exit lens 12. The curved front edges of the two planar portions together define a semi-ellipse or semi-circle with an upper-most point coincident with the light exit window 28 of the collimating element.

The planar shutter element is positioned and shaped so as to reflect or absorb portions of the light reflected from the reflective surface 22 of the reflector structure 20 which would fall above a critical horizontal line at the exit lens 12, for example the central horizontal line 13. The two planar portions may be arranged so as to align vertically with the two vertical 'levels' defined by first 38 and second 39 portions of the stepped profile 32 of the light exit window 28, for example. In this way, the two portions may provide sharp horizontal cut-off lines to the low beam profile on either side of the stepped cut off portion (provided by sloping section 37).

Figure 11:
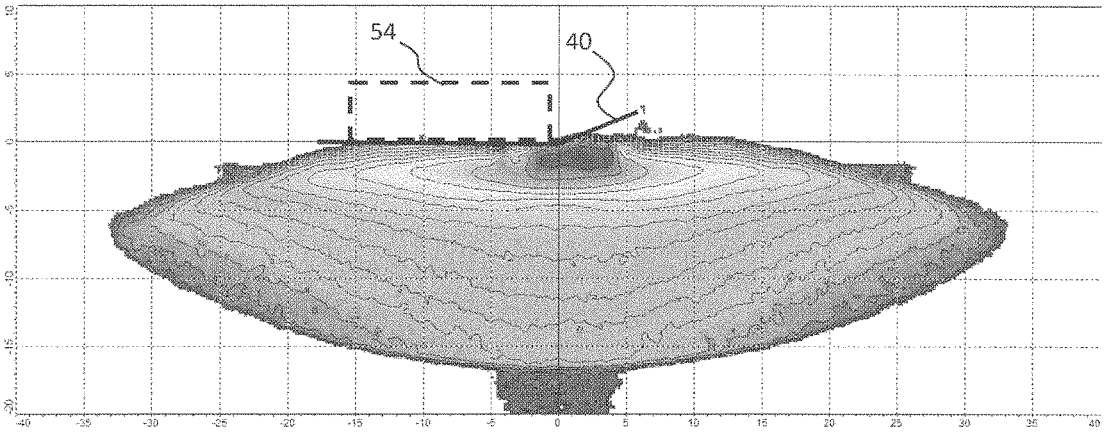
FIG. 11 depicts a simulated representation of the total beam profile generated by the second example headlight module.
Figure 12:
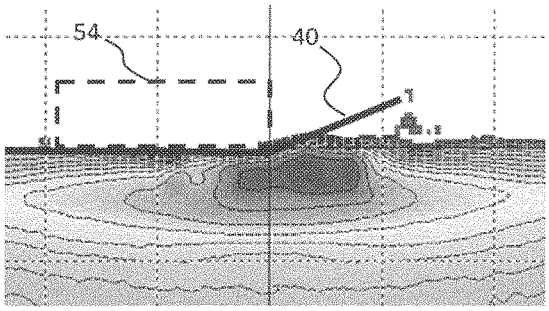
FIG. 12 depicts a second view of the simulation of the total beam profile generated by the second example headlight module.

The effect of the shutter element may be seen in FIG. 11 which depicts a simulated representation of an example beam profile generated by the headlight module of FIGS. 9 and 10. A close-up view of the portion of the beam generated by the collimating element is shown in FIG. 12, with the stepped cut off indicated by line 40. It can be seen in both FIGS. 11 and 12 that, in comparison with the simulated profile shown in FIGS. 7 and 8, the beam exhibits a much flatter, more even, horizontal cut off on either side of the sloping portion of the step. In particular, in the rectangular region of the profile indicated by box 54 (in FIGS. 11 and 12) there is virtually no light distributed at all, whereas in the equivalent region of the profiles of FIGS. 7 and 8, a portion of the lower beam profile penetrates above a sharp horizontal upper cut-off.

In some examples, the shutter may be a single (non-divided) unit, for example a single unit being integral to the collimating element 26, and having sections which extend laterally from opposite sides of the collimator.

According to various examples, the collimating element 26 may be a total internal reflection (TIR) collimator, wherein light rays entering the input window 36 at an angle exceeding the critical angle of the collimator are transmitted through surfaces 35 and 31, and only rays below the critical angle are conserved.

In alternative examples, upper surface 35 and lower surface 31 may comprise opposing reflective surface elements of an open collimating reflector structure. The collimating element in this case does not comprise an enclosed channel constraining the shape of the output beam, but rather a bi-surface reflector, for example a TIR reflector.

According to further examples, the collimating element 26 may comprise a collimating lens or other optical component, such as, by way of non-limiting example a Fresnel lens or Fresnel foil.

The collimating element 26 may, by way of non-limiting example, be made of plastics, glass and/or silicon materials.

Although in the example of FIGS. 1 and 2, the reflector structure 20 is an ellipsoid reflector structure, in alternative examples, different shaped reflectors may be used. For example reflectors of other conical cross section shapes, such as spherical, for instance.

The ellipsoid reflector 20 may, by way of non-limiting example, be made of plastics or metal, and may be coated on the inner and/or outer surface with a reflective coating material.

As described above, by combining a standard Poly Ellipsoid System (PES) arrangement (comprising the reflector structure 20, the first LED 18, and the exit lens 12) with an additional second beam unit, comprising optically coupled second LED and collimating element 26, embodiments of the invention are able to provide simultaneously a wide-distribution low beam element, and a smaller, highly concentrated beam element, the latter of which may be employed to add shape to the wide-distribution element, or to provide its own distinct auxiliary (high-intensity) beam.

In the above described set of embodiments, the collimator (and second LED) is utilized to project an angled cut off onto the low-beam profile generated by the PES system. However, according to a second set of embodiments (to be described below), the collimating element (subject to design adjustments) may be used to provide an additional high beam (i.e. full beam) component, which may be illuminated in concert with the low-beam, or may be lit on its own.

Figure 13:
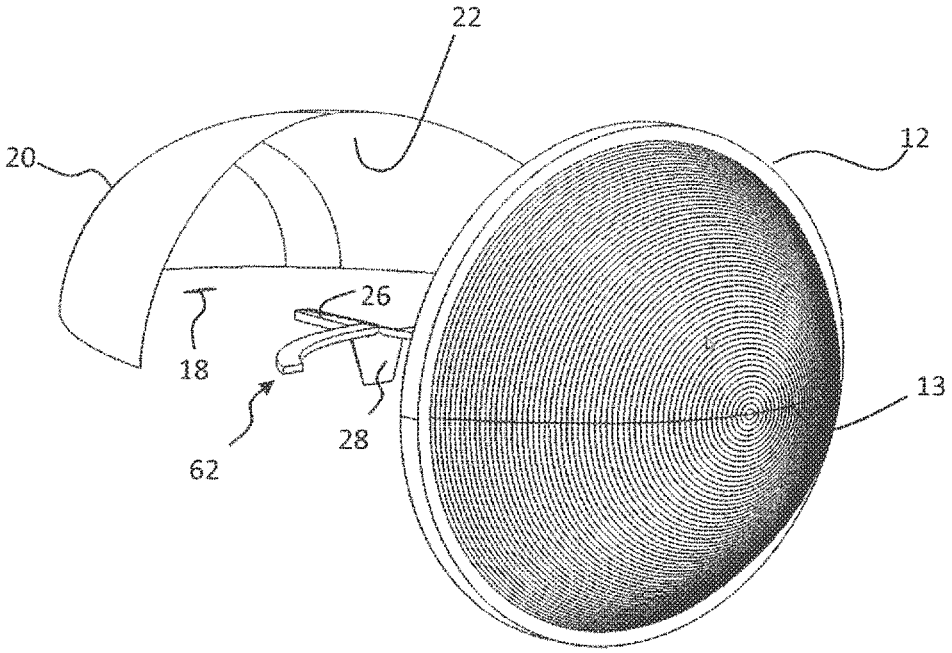
FIG. 13 schematically depicts a first perspective view of a third example headlight module.
Figure 14:
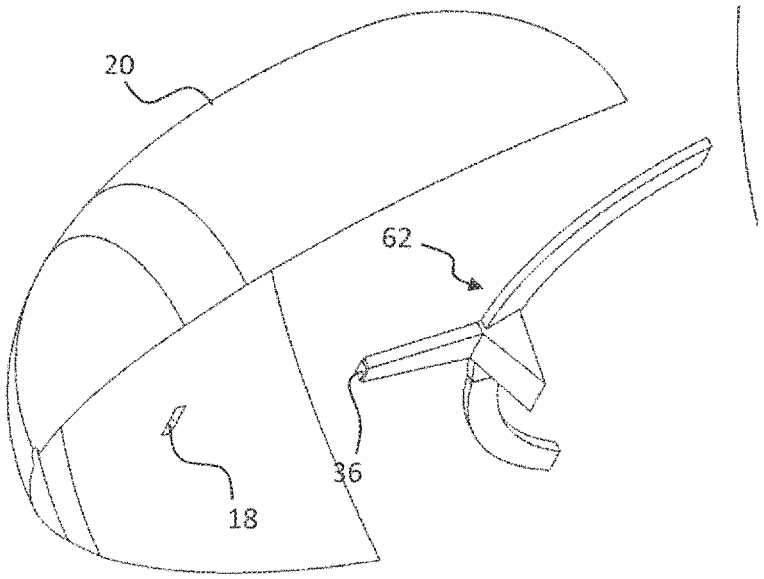
FIG. 14 schematically depicts a second perspective view of the third example headlight module.

FIGS. 13 and 14 schematically depict perspective and profile views respectively of an example of such a dual beam headlight module 2, adapted to generate both a low beam (having a stepped upper cut off) and a (for example higher intensity) high beam, the two being operable independently. The arrangement of the module is substantially the same as that of the example of FIGS. 1 and 2, wherein the reflector 20 is arranged arching over the first LED 18, and having its inner surface 22 arranged to reflect incident light in the direction of a first region of the exit lens 12. Between the first LED and the exit lens is positioned a collimating element 26, having light input window 36 optically coupled to the second LED 24 (not shown), and light output window 28 facing in the direction of a second (possibly overlapping) region of the exit lens.

Figure 15:
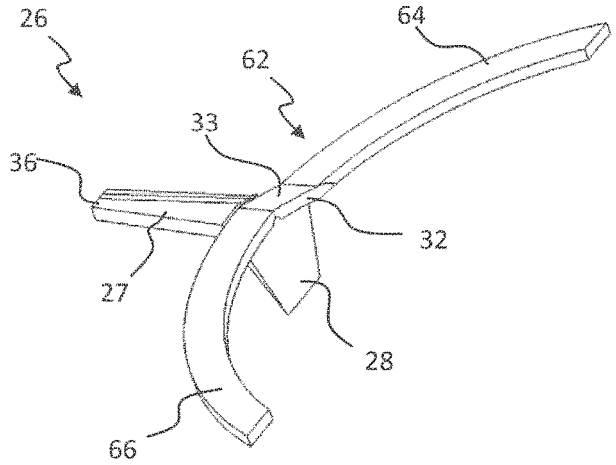
FIG. 15 schematically depicts a first view of a second example collimating element.
Figure 16:
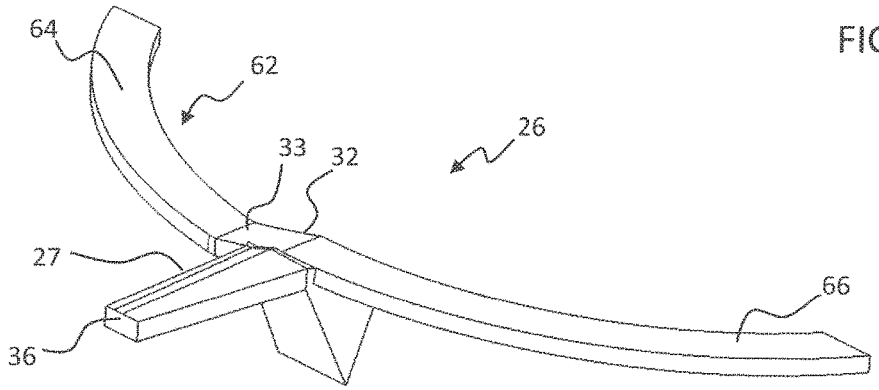
FIG. 16 schematically depicts a second view of the second example collimating element.
Figure 17:
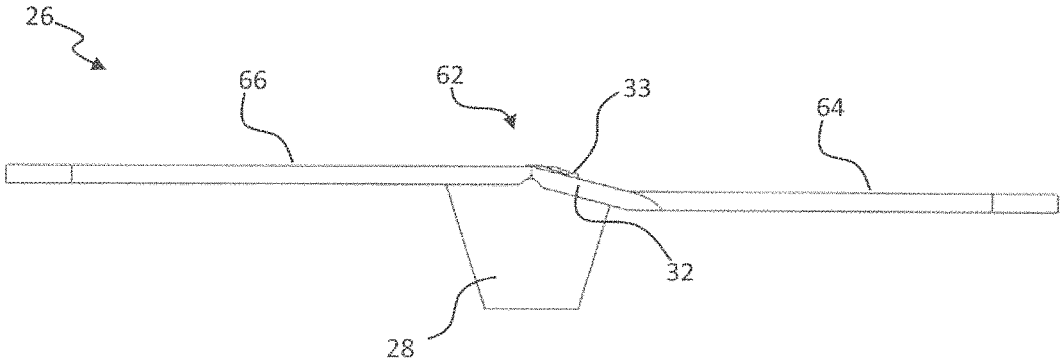
FIG. 17 schematically depicts a third view of the second example collimating element.

The structure of the collimating element 26 in this example can be seen more clearly in FIGS. 15-17, which show perspective views of the element from different respective angles. The collimator comprises the same primary optical chamber 27 of the collimating element of FIGS. 3-5, but comprises an extended light exit window 28, having an output area greater than the input area of the input window 36, and having a lower boundary which extends below the corresponding lower boundary of the input window. The output window generates luminous output being directed to a point/region on the exit lens which is either partially or entirely above the central horizontal line 13.

The stepped profile 32 comprises a reflective upper surface 33, which, as can be seen from FIGS. 13 and 14 is positioned within the light path of the first luminous distribution generated by the reflector structure 20. The reflective surface 33 has the effect of shaping the luminous distribution generated by the reflector and first LED 18, so as to form at the exit lens a low beam profile comprising a stepped upper boundary. The reflective surface 33 of course achieves this whether or not the second LED 24 and collimating element are optically active at the time. By positioning the collimating element 26 appropriately, the angled reflective surface 33 provides an angled cut-off to the low beam projected onto the exit lens 12 by the reflector structure 22, the surface 33 reflecting portions of light which fall above the stepped profile defined by the surface.

Extending outwards from the two ends of the stepped profile 32 are a first 64 and second 66 curved section of a curved reflector element 62, each comprising a reflectively coated planar top surface. As can be seen from FIGS. 12 and 13, two curved sections arc outward from the top of the light exit window 28 toward the exit lens 12. Each of the curved sections comprises a reflective upper surface. As can be seen from FIG. 17, the planar top surface of each of the curved sections is oriented substantially parallel with a horizontal plane, such that, in combination with the stepped surface 33, the curved reflector, positioned in the light path of the first luminous distribution (generated by the reflector structure 22) acts to provide a substantially flat, horizontal (i.e. 0°) cut-off on either side of the stepped cut off generated by the stepped profile 32.

On lighting only the first LED 18, the headlight module 2 generates a low beam profile having a stepped cut-off following the profile of combined curved reflector 62 and stepped surface 33 (shown in FIG. 17). On lighting just the second LED 24 (optically coupled with the light input window 36 of the collimating element 26) the headlight module 2 generates a high-beam having a profile following an inverted form of the shape of the light exit window 28. The high beam comprises a stepped lower cut off. On lighting both LEDs, the headlight module 2 generates both a low beam, having a stepped upper cut off, and a high beam, having a shape which mirrors the shape of light exit window 28.

Figure 18:
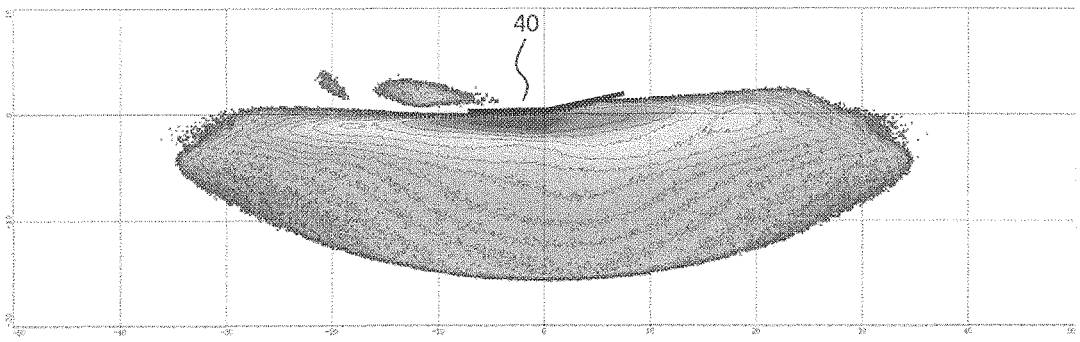
FIG. 18 depicts a simulated representation of the low beam profile generated by the third example headlight module.

FIG. 18 depicts a simulated representation of the low beam profile generated by the first LED 18 and reflector structure 20. The stepped upper cut-off generated by stepped profile 32 is indicated by line 40. The effect of the curved reflector 62 is evident in the substantially flat horizontal cut off lines at either side of the stepped profile 40.

Figure 19:
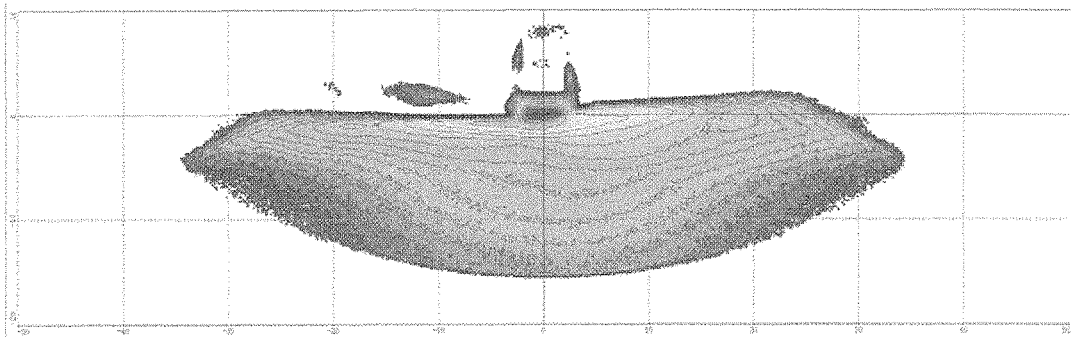
FIG. 19 depicts a simulated representation of the high beam profile generated by the third example headlight module.

FIG. 19 depicts a simulated representation of the total high beam profile generated by activating both the high beam (of the collimator 26 and second LED 24) and the wide-distribution low beam of FIG. 18. As can be seen, an upper portion of the high beam extends above the upper level of the low beam portion (above its horizontal cut off). This may be contrasted for example with the simulated representation in FIG. 7 of the total beam profile generated by the embodiment of FIGS. 1 and 2, wherein the upper boundary of the second (collimated) beam portion is substantially flush with the upper boundary of the wide distribution (reflected) beam portion.

The collimating element 26 of the example headlight unit of FIGS. 12 and 13 may be manufactured by simple mold injection processes, avoiding the need for complex and expensive computerized numerical control processes necessary in manufacturing components of many state of the art dual-beam headlight modules.

In addition, no moving parts for switching between high beam and low beam modes (actuated for example by a solenoid) are required in the embodiment of FIGS. 13 and 14. Rather the two may be realized merely by activation and deactivation of the two provided LEDs 18, 24. This again, reduces the complexity, cost, weight and bulk of the headlight module.

Examples of the headlight module, in accordance with any of the above described embodiments, may further comprise one or more LED driver modules for controlling and/or regulating the electrical, optical or other operational parameters of the first and/or second LEDs.

In examples, there may additionally be provided one or more thermal management modules or elements, for managing the dissipation of heat from one or both of the LEDs. The thermal management modules may, by way of non-limiting examples, comprise heat sink elements, heat dissipation channels or conduits, thermal vias, and/or one or more air channels for the convection of or fluid transfer of heat.

In certain variations on the embodiments, there may further be provided one or more motor or actuation elements for adjusting the position and/or angular orientation of collimating element 26 (relative to the exit lens 12 for example). Since in all of the above described embodiments, features of the collimating element generate the stepped cut-off in the generated low beam distribution, adjustment of the either the vertical or lateral position of the collimator relative to the lens, and/or of the angular orientation of the collimator, allows the projected position of the cut-off on the exit lens (and hence its 'position' within the beam profile generated by the module 2) to be varied. The provision of motor or actuator elements may allow the positioning of the cut-off line to be adapted dynamically, in real time, while the module is being operated, for example. This functionality could be used to facilitate the provision of dynamic beam shaping by the headlight module, i.e. to facilitate an Adaptive Frontlighting System (AFS), wherein the directionality and/or shape of the beam may dynamically adjusted in response to changing road/weather conditions, for example, or changing traffic scenarios.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A headlight module for outputting a low beam profile including a cut off section for projection towards a driver-side road section, the headlight module comprising:

an exit lens comprising an optical axis extending through said exit lens;

a low beam unit for generating at least a portion of said low beam profile, the low beam unit comprising:

a first LED for generating a first luminous distribution; and a reflector structure for reflecting the first luminous distribution onto a first region of the exit lens to generate said at least portion of the low beam profile;

a second beam unit in between the low beam unit and the exit lens, the further beam unit comprising:

a second LED; and a collimating element being optically coupled with the second LED through a light input window and having a light output window facing the exit lens such that the light output window generates a second luminous distribution onto a second region of the exit lens, the collimating element comprising a surface including a stepped profile for generating said cut off section, wherein the second luminous distribution is a further portion of the low beam profile, said further portion including the cut off section, and wherein the stepped profile delimits the light output window, wherein the headlight module further comprises a planar shutter element positioned within the light path of the reflected first luminous distribution, substantially parallel with the surface, for creating an upper horizontal cut-off to the lower beam profile, the planar shutter element comprising a first planar portion positioned adjacent to a first lateral side of the surface, and having a first curved front edge which curves toward the exit lens, and a second planar portion positioned adjacent to a second lateral side of the surface, and having a second curved front edge which curves toward the exit lens.

2. The headlight module as claimed in claim 1, wherein said second region of the exit lens is adjacent to or overlapping with said first region of the exit lens.

3. The headlight module as claimed in claim 1, wherein the collimating element further comprises a planar further surface opposite said surface, said further surface comprising a further surface portion adjoining the light output window, the further surface portion carrying a reflective coating.

4. The headlight module as claimed in claim 1, wherein the collimating element comprises a first reflector including the surface and an opposing second reflector including the further surface.

5. The headlight module of claim 4, wherein the first reflector and the second reflector are spatially separated.

6. A headlight module for outputting a low beam profile including a cut off section for projection towards a driver-side road section, the headlight module comprising:

an exit lens comprising an optical axis extending through said exit lens;

a low beam unit for generating at least a portion of said low beam profile, the low beam unit comprising:

a first LED for generating a first luminous distribution; and a reflector structure for reflecting the first luminous distribution onto a first region of the exit lens to generate said at least portion of the low beam profile;

a second beam unit in between the low beam unit and the exit lens, the further beam unit comprising:

a second LED; and a collimating element being optically coupled with the second LED through a light input window and having a light output window facing the exit lens such that the light output window generates a second luminous distribution onto a second region of the exit lens, the collimating element comprising a surface including a stepped profile for generating said cut off section, wherein the second luminous distribution is a high beam portion, and wherein the stepped profile is positioned within the light path of the reflected first luminous distribution and comprises a reflective surface for creating said cut off section in the low beam profile.

7. The headlight module as claimed in claim 6, wherein the reflective surface is comprised by a curved reflector having:

a first curved section adjacent to a first end of the stepped profile and curving towards the exit lens; and a second curved section adjacent to a second end of the stepped profile opposite said first end and curving towards the exit lens, wherein the first curved section is vertically displaced relative to the second curved section.

8. The headlight module of claim 7, wherein the curved reflector is integral to the collimating element.

9. The headlight module as claimed in claim 6, wherein the light output window is larger than the light input window and has a lower boundary extending below the lower boundary of the light input window.

10. The headlight module as claimed in claim 6, wherein the stepped profile is shaped to define a cut off portion having a cut off angle of 15 or 45 degrees with respect to a horizontal plane.

11. The headlight module as claimed in claim 6, wherein the reflective surface area of the reflector structure is greater than the area of the light output window of the collimating element, such that the low beam unit is adapted to generate a major area of a combined beam profile generated by the low beam unit and the further beam unit.

12. A headlight module as claimed in claim 6, further comprising one or more motor or actuation elements for adjusting a position and/or relative orientation of the collimating element.

13. A vehicle comprising the headlight module as claimed in claim 6.

* * * * *